United States Patent [19]

Schluep et al.

[11] Patent Number: 4,530,390

[45] Date of Patent: Jul. 23, 1985

[54] VENETIAN BLIND SUSPENSION MEMBER SUPPORT LINK CONSTRUCTION

[75] Inventors: René Schluep, Tobel; Hugo Eisenring, Balterswil, both of Switzerland

[73] Assignee: Griesser AG, Switzerland

[21] Appl. No.: 514,659

[22] Filed: Jul. 18, 1983

[30] Foreign Application Priority Data

Aug. 27, 1982 [CH] Switzerland ..... 5266/82

[51] Int. Cl.[3] ..... E06B 9/38

[52] U.S. Cl. ..... 160/178 R

[58] Field of Search ..... 160/174, 178 R, 178 E, 160/178 F; 411/22, 448, 449, 477, 485, 493–497, 500–504

[56] References Cited

U.S. PATENT DOCUMENTS

| | | | |
|---|---|---|---|
| 2,329,471 | 9/1943 | King | 411/495 |
| 2,502,267 | 3/1950 | McPherson | 411/22 |
| 3,916,973 | 11/1975 | Schuppler et al. | 160/178 R |
| 4,154,281 | 5/1979 | Schluep | 160/178 E |
| 4,460,301 | 7/1984 | Wahlstrom | 411/501 |

FOREIGN PATENT DOCUMENTS

| | | | |
|---|---|---|---|
| 3009058 | 11/1980 | Fed. Rep. of Germany | 160/174 |

*Primary Examiner*—Peter M. Caun

*Attorney, Agent, or Firm*—McGlew and Tuttle

[57] ABSTRACT

A metallic link for a blind slat having a flange comprises a head portion with a suspension aperture for receiving a supporting loop, and with stop shoulders applying against the outer wall of the flange. Integral with the head parts is a clamping ring portion having at least one cutting edge on its front end. Initially, the clamping ring is straight and longer than the width of the cavity formed by the flange. Then, the ring portion is driven through the outer wall of the flange, up to the stop shoulders of the head. As the cutting edge 5 pierces the inner wall of the flange, the clamping ring undergoes a permanent deformation and buckles so that its sides are bent out and the ring becomes firmly clamped in the flange. Except for a ram for driving the link in, no other tool is needed.

7 Claims, 4 Drawing Figures

Fig. 1
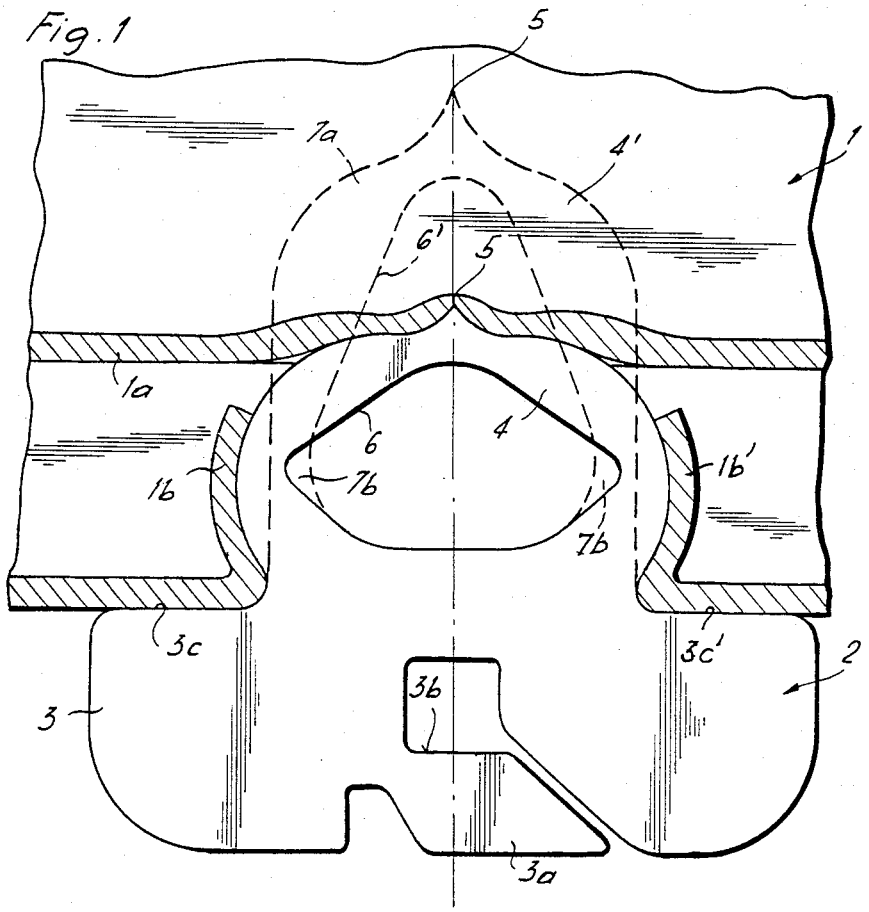
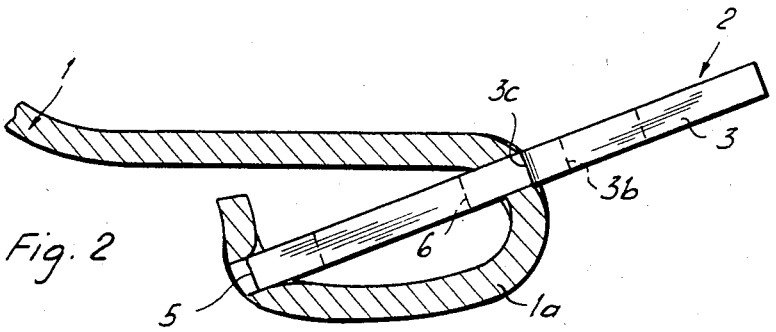
Fig. 2

VENETIAN BLIND SUSPENSION MEMBER SUPPORT LINK CONSTRUCTION

FIELD AND BACKGROUND OF THE INVENTION

This invention relates in general to the construction of venetian blinds and in particular to a new and useful slat engaging support link for a suspension member.

Known are venetian blinds of this kind, for example from Swiss Pat. No. 591 006 in which loops interweaved with suspension cords embrace webs of U-shaped staples serving as links and having pointed protruding legs which are driven diametrically through the entire flange of the slat and bent therebehind, as usual with conventional slats. Aside from the unsatisfactory clamping power of a staple, for example under conditions of handling the blind, such a connection is hardly suitable for an automation in manufacture, particularly because of the necessity of having a bending tool placed at the rear side of the flange.

SUMMARY OF THE INVENTION

The present invention is directed to a venetian blind requiring no bending of the end portions of members entirely penetrating the flanges to connect the slats to the supporting elements, and thus permitting a full automation of the connecting operation.

In accordance with the invention, the support link for a venetian blind which has slats suspended from supporting elements which are connected to the slats by the support link include slats which have a flange with a hollow cavity. The support links are driven into the wall of the flange and extend through the cavity to the opposite wall. The support link advantageously comprises a thin metallic link having a widened head portion with a clamping ring portion extending outwardly from a side of the head portion which terminates in an outer cutting edge which is driven into the wall of the slat and into the opposite wall formed by a flange portion of the slat. The link is driven in by a ram-like tool and after the cutting edge penetrates into the opposite wall of the flange the side walls of the clamping ring part bulge outwardly against the walls which have been pierced by the slat flange so as to form a secure clamping engagement therewith. To facilitate the buckling of the walls the clamping ring portion is provided with an opening constructed so as to facilitate the collapse of the ring portion in the areas which bear against the walls of the slat flange.

Advantageously, the clamping ring is closed on all sides and designed with suitable weakened cross sections between the cutting edge or point and the head of the link, ensuring that the buckling caused by the striking of the cutting edge, or point, against the opposite wall of the flange will actually result in an outward bending of the initially straight sides of the ring. As the ring is driven into the first wall of the flange, narrow wall strips are torn out therefrom by the ring, which then snugly apply against the bent-out side portions of the ring and thus contribute to the transverse clamping of the buckled ring of the link, in addition to the clamping in the longitudinal direction of the flange. Quite similarly, the cutting edge driven into the opposite wall of the flange, along with the part adjacent the head, fixes the link in a direction perpendicular thereto. The link is thereby firmly secured in the flange and cannot become loose by the loads acting thereon through the suspension loop during an actuation of the blind.

Accordingly, it is an object of the invention to provide a support link for holding a suspension element to a venetian blind slat which has an end with a hollow flange into which the support link is driven and wherein the support link includes an end having a cutting edge for penetrating the slat flange and engaging it to the opposite side thereof and which is constructed so that includes a clamping ring portion which bends into tight wedging engagement with the wall that is pierced by the cutting link portion.

A further object of the invention is to provide a venetian blind which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

BRIEF DESCRIPTION OF THE DRAWINGS

In the drawings:

FIG. 1 is a longitudinal sectional view of a first embodiment of a link driven into the flange of a slat;

FIG. 2 is a cross sectional view corresponding to FIG. 1;

DESCRIPTION OF THE PREFERRED EMBODIMENTS

Figure 3:
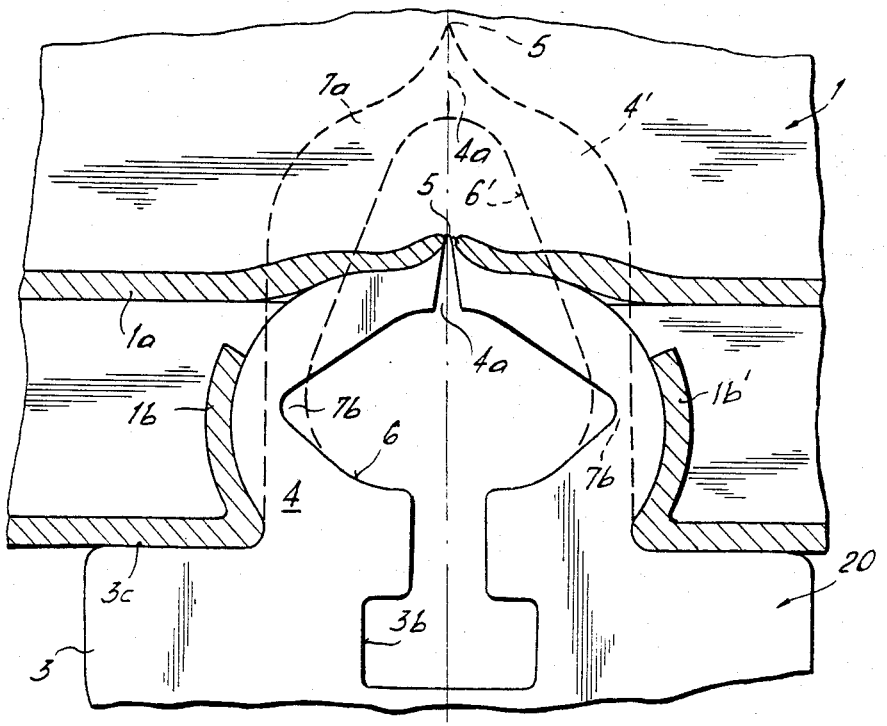
FIG. 3 is a view similar to FIG. 1 showing a second embodiment.

Referring to the drawings in particular the invention embodied therein, in FIGS. 1 and 2, comprises a support link 2 for a venetian blind which includes a plurality of slats 1 having a flange portion 1*a* which is hollow and which includes an outer wall which is penetrated by a support link 2 which is provided with an outer cutting edge 5 on a clamping ring portion 4 thereof which penetrates through the outer wall of the flange and into the opposite interior wall at the other end of the cavity formed by the flange. In accordance with the invention, in order to facilitate clamping engagement of the support link, the clamping ring portion 4 is provided with an aperture 6 to aid in the bending of the side walls of the clamping ring portion so that they deform into engagement with the wall portions 1*b* and 1*b'* of the outer wall of the slat and the cutting edge engages with the opposite wall of the slat.

FIGS. 1 and 2 show a conventional slat 1 of a venetian blind, having flanges 1*a* which, for example, are bent both in the same direction (only one flange is shown). Fixed to these flanges are links 2 to which textile loops (for example, not shown) of a suspension strap are attached. As shown in FIG. 2, the links 2 are designed as relatively thin, flat elements which advantageously, are produced by stamping. They comprise a head 3 provided with an aperture 3*b* which can be closed by a bendable lug 3*a* and is intended for being engaged by a textile loop (not shown) fixed to the suspension strap. On the inner side of head 3, two shoulders 3*c* and 3*c'* are formed between which a clamping ring part 4 projects away from head 3. Initially, in an unmounted state, which is shown in FIG. 1, in broken lines at 4', the two outsides of clamping ring 4 project from shoulders 3c at right angles to curve inwardly and then outwardly to a pointed front portion having a central cutting edge 5. The aperture 6' of the ring in initial state has the shape of a rounded triangle of such configuration that weakened-section portions 7a and 7b are formed at either side of cutting edge 5 and adjacent head 2. The axial length of clamping ring 4' in an initial state, measured from shoulders 3c to cutting edge 5, is substantially longer (about twice as long in practice) than the diameter of the flange at the location where the clamping ring is driven in.

To fix link 2 in place, the slat is properly fixed in position and the link is driven with its cutting edge 5 ahead and by means or a ram (not shown) through the outer wall of flange 1a into the cavity thereof. This causes the outside edges of the clamping ring to progressively cut themselves into the wall of the flange, so that metal strips 1b and 1b' corresponding in width to the thickness of the clamp ring are cut out from the wall and bent inwardly. As soon as cutting edge 5 of clamping ring 4 during the drive strikes against the opposite wall of the flange, the cutting edge will still penetrate further into that wall and maybe also cut it out or through. However, since metal strips 1b and 1b' act as an additional braking force, the impact will be attenuated and the permanently deformable clamping ring will buckle, initially slightly and then gradually stronger. Due to the weakened sections 7a, 7b, during this buckling and bending, the ring portions adjacent cutting edge 5 apply against the inner wall of the flange, since the side portions of ring bend outwardly. In addition, inwardly bent wall strips 1b are further bent too. The driving and buckling process is terminated as soon as shoulders 3c and 3c' of the head 2, acting as stops, butt against the outside of flange 1a. The shape to which clamping ring 4 has thus been permanently deformed with the ring aperture contracted, necessarily results in a three-dimensional firm clamping of the link in or to the flange 1a. It will be understood, of course, that the dimensions of the link stamped of annealed stainless steel, for example, i.e. the initial length of the clamping ring, shape, and size of the various cross sections of the ring and the cutting edge, will be adjusted to the shape, size, and wall thickness of the flange. A substantial requirement in this connection is to provide a sufficient buckling length of the clamping ring, and an initial ring aperture and weakened sections such as to ensure an outward bending of the two sides of the ring.

In this embodiment of FIGS. 1 and 2, the supporting loops of the suspension straps can be engaged into apertures 3b before as well as after driving the links in. Cutting edges 5 may in some instances be made more pointed. Also, care must be taken not to let a noise dampening and sealing strip of plastic or rubber which may be inserted in the flange interfere with the anchoring of the link.

In the above described embodiment, the aperture 6 of the clamping ring part 4 of link 2 is and remains closed. In another embodiment, such as the link 20 according to FIG. 3, the clamping ring part 4' or 4 may be cut through in the zone of cutting edge 5, as shown as 4a. The result is that upon impinging on the inside wall of flange 1a, the front portions forming the cutting edge of the clamping ring bend inwardly somewhat easier; the cutting edge proper is maintained, however. While in the embodiment of FIGS. 1, 2, ring aperture 6 is is separated from the loop engaging aperture 3b of head 2, in this embodiment of FIG. 3, the two apertures 6 and 3 communicate with each other. A temporary cleaving of the slit at 4a of clamping ring 4' makes it possible to introduce the supporting loop prior to mounting link 2. Even in this embodiment with a slit clamping ring, however, a separate aperture 3b for the supporting loop closable by a bending lug 3a, in accordance with FIG. 1, might be provided.

Figure 4:
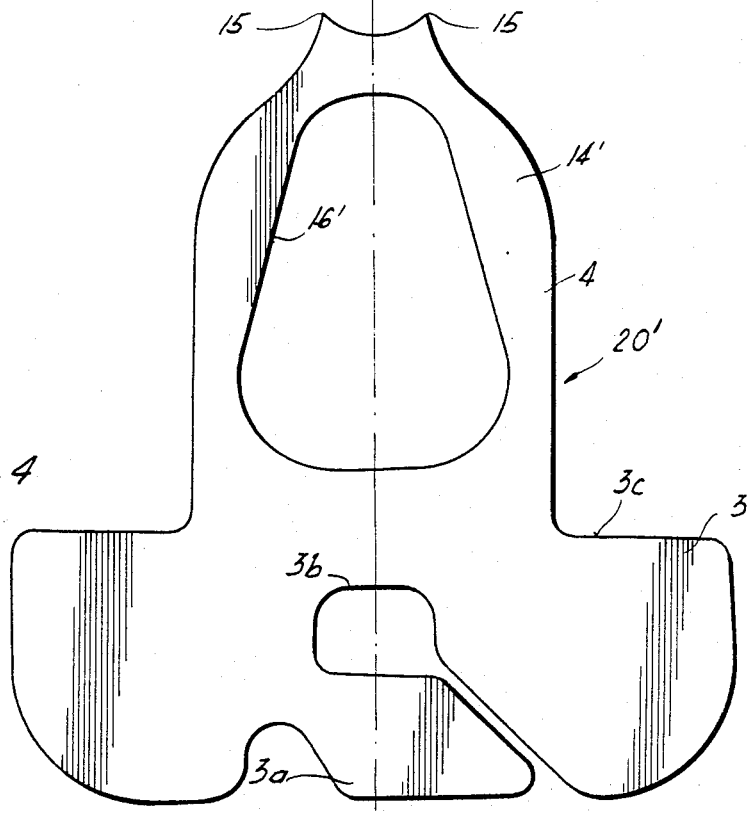
FIG. 4 illustrates a third embodiment of the link in its initial state.

Another embodiment of a link 20' is shown in FIG. 4. In this design, a permanently deformable clamping ring 14' is provided with two cutting edges 15. While driving such a link 2 into flange 1a, a wall strip corresponding to the spacing of the two cutting edges is cut out of the flange wall so that the other wall strips 1b and 1b' to be bent outwardly, are somewhat shorter in this instance. Therefore, it will be understood that in this embodiment, the clamp ring aperture 16' must be a little enlarged in the zone of the cutting edges, to ensure a satisfactory bending of the side portions of the clamping ring during the buckling period.

While specific embodiments of the invention have been shown and described in detail to illustrate the application of the principles of the invention, it will be understood that the invention may be embodied otherwise without departing from such principles.

What is claimed is:

1. A support link for a venetian blind wherein the slats of the blind are supported on supporting elements which are connected to the slats by a support link and wherein the slats have hollow flanged ends with a hollow cavity therein, comprising a flat metallic piece having a head portion and a clamping ring portion integrally formed with said head portion which extends outwardly from a side of said head portion and is of a length greater than the diameter of the hollow flange and which comprises two substantially parallel side edges and at least one cutting edge at its outer end, said cutting edge being drivable through the outer wall of the flange portion and through the hollow interior to opposite interior wall of the flange portion, said clamping ring portion having an aperture between the side edges located to facilitate buckling of the clamping ring portion against the walls of the flange which are penetrated by the cutting edge to form a clamping engagement therewith, said flange portion including an outer wall with wall strips which are cut out of said outer wall and are bendable into the hollow portion thereof by engagement of said clamping ring into said flange portion.

2. A support link according to claim 1, wherein said head portion is wider than said clamping ring portion and has a stop shoulder on each side of said clamping ring portion which engages against the face of the slot flange.

3. A support link according to claim 1, wherein said side portions of said clamping ring portion include a weak-section bending in this area during the buckling process.

4. A support link according to claim 1, wherein said head portion includes a suspension aperture, said head portion including a bending lug which is engaged by a suspension loop of the supporting element.

5. A support link according to claim 1, wherein said clamping ring portion has a plurality of cutting edges at spaced apart locations.

6. A support link according to claim 1, wherein said clamping ring portion is provided with an aperture centered between the sides thereof and including a slit portion extending from said aperture toward the cutting edge.

7. A support link for a venetian blind in which the slats of the blind are supported on supporting elements which are connected to the slats by a support link and wherein the slats have an end with a hollow flange with a hollow cavity therein, said support link comprising a flat metallic piece having a head portion and a clamping ring integrally formed with said head portion which extends outwardly from a side of said head portion and is of a length greater than the diameter of the holow cavity and which comprises two substantially parallel side edge portions and an outer end forming a cutting edge, said cutting edge being drivable through the outer wall of the hollow flange and through the hollow cavity to the opposite interior wall of said hollow flange, said clamping ring having an aperture between the side edge portions and the cutting edge located to facilitate upsetting of the clamping ring by buckling outwardly its side edge portions upon impacting of said clamping ring-cutting edge on to the opposite interior wall of said hollow flange and thus clamping said upset clamping ring against the walls of said hollow flange to form a clamping engagement therewith.

* * * * *